United States Patent [19]

Serganoli

[11] 4,372,326

[45] Feb. 8, 1983

[54] MANUFACTURING MACHINE FOR PRODUCING TWO CONTINUOUS CIGARETTE RODS

[75] Inventor: Enzo Serganoli, Bologna, Italy

[73] Assignee: G. D. Societa' per Azioni, Italy

[21] Appl. No.: 254,975

[22] Filed: Apr. 16, 1981

[30] Foreign Application Priority Data

May 26, 1980 [IT] Italy ..... 48787 A/80
Feb. 16, 1981 [IT] Italy ..... 47806 A/81
Feb. 16, 1981 [IT] Italy ..... 47807 A/81

[51] Int. Cl.[3] ..... A24C 5/18; A24C 5/39
[52] U.S. Cl. ..... 131/84 B; 131/84 R; 131/108
[58] Field of Search ..... 131/93, 94, 95, 96, 131/84 R, 84 A, 84 B, 84 C, 108

[56] References Cited

U.S. PATENT DOCUMENTS 3,736,941 6/1973 Molins et al. ..... 131/84 B
3,987,804 10/1976 Molins et al. ..... 131/84 B
4,175,570 11/1979 Heitmann et al. ..... 131/84 B

FOREIGN PATENT DOCUMENTS 1179386 1/1970 United Kingdom ..... 131/84 C

*Primary Examiner*—J. Millin
*Attorney, Agent, or Firm*—Merriam, Marshall & Bicknell

[57] ABSTRACT

A manufacturing machine for simultaneously producing two continuous cigarette rods, in which a continuous flow of shredded tobacco particles is fed to the lower end of a rising duct, an upper portion of which is constituted by two rising channels terminating below a suction conveyor belt and disposed side-by-side in a direction transverse to the direction of movement of this latter.

21 Claims, 7 Drawing Figures

Fig.1
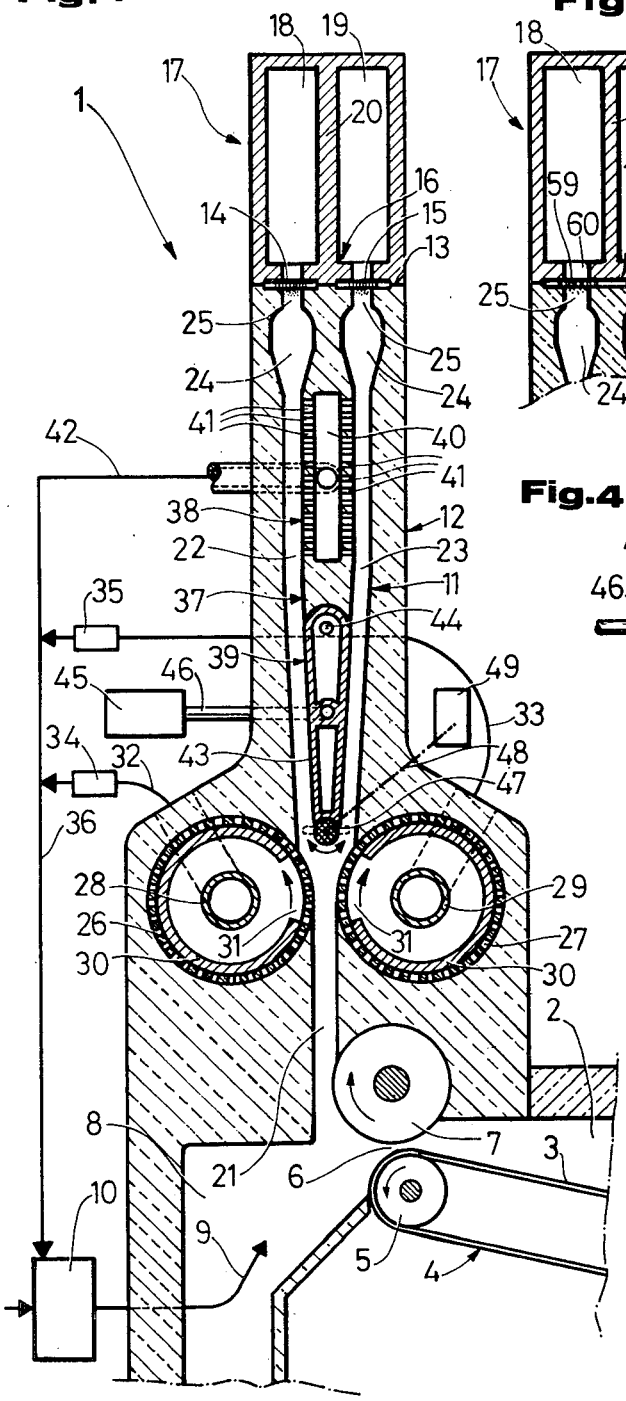
Fig.2
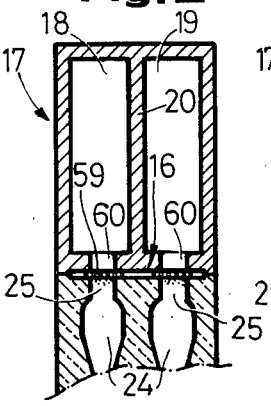
Fig.3
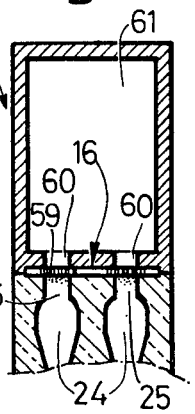
Fig.4
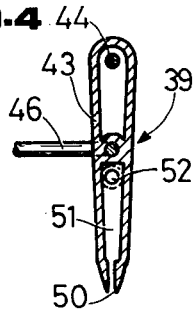
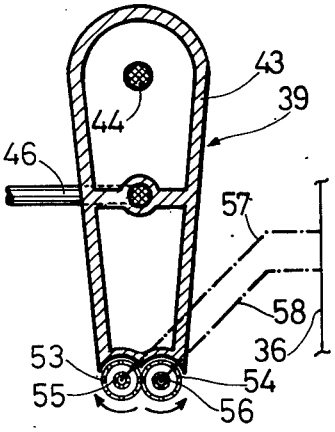
Fig.5

MANUFACTURING MACHINE FOR PRODUCING TWO CONTINUOUS CIGARETTE RODS

BACKGROUND OF THE INVENTION

This invention relates to a manufacturing machine for simultaneously producing two continuous cigarette rods.

In manufacturing machines of the aforesaid type, it is known to use a carding unit constituted by a plurality of carding rollers, and arranged to produce at its exit a stream of tobacco particles having a width substantially equal to the length of said carding rollers.

This tobacco stream is normally divided into two parts in the direction of its length, in order to form two streams of tobacco particles, which are fed to respective rising channels which are closed upperly by respective suction belts.

In known manner, each of these latter collects the respective tobacco particles, and feeds them in the form of a continuous filler on to a paper web.

One of the drawbacks of the aforesaid known manufacturing machines is the fact that the tobacco stream leaving the carding unit does not always have perfect uniformity in the direction of its length because of a non-homogeneous distribution of tobacco particles of different physical characteristics therein.

A consequence of this is the formation of two fillers of different thickness and/or different weight per unit length.

SUMMARY OF THE INVENTION

The object of the present invention is to provide a manufacturing machine able to divide the tobacco stream leaving the carding unit into two substantially identical streams.

Said object is attained according to the present invention by a manufacturing machine for simultaneously producing two continuous cigarette rods, in which a continuous flow of shredded tobacco particles is fed to the lower end of a rising duct comprising at least two rising channels, each terminating below a suction conveyor mobile in a determined direction of movement, characterised in that said channels constitute an upper portion of said duct, which lowerly comprises a single rising conduit connected upperly to both said channels; these latter being at least partly side-by-side in a direction transverse to said direction of movement.

BRIEF DESCRIPTION OF THE DRAWINGS

Further characteristics and advantages of the present invention will be apparent from the description given hereinafter with reference to the accompanying drawings, in which:

FIG. 1 is a diagrammatic cross-section, partly in block form, of a terminal rod formation portion of a manufacturing machine constructed in accordance with the present invention;

FIGS. 2 and 3 are diagrammatic sections through respective modifications of a first detail of FIG. 1;

FIGS. 4 and 5 are diagrammatic sections through two modifications of a second detail of FIG. 1.

DETAILED DESCRIPTION OF THE INVENTION

Figure 7:
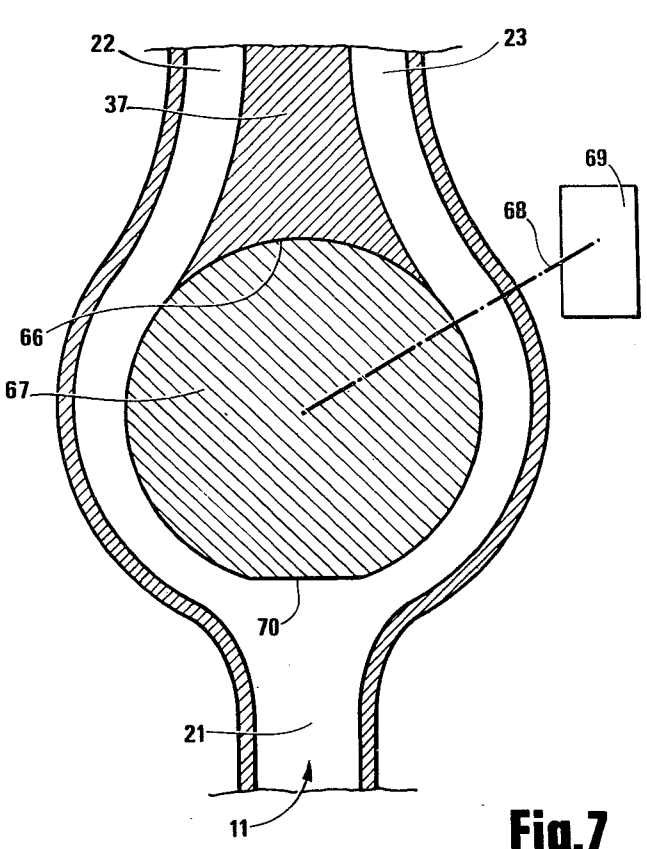
FIGS. 6 and 7 are diagrammatic sections through two modifications of a third detail of FIG. 1.

FIG. 1 shows a manufacturing machine indicated overall by 1, and comprising an inner chamber 2, the base of which is defined by the upper branch 3 of a conveyor belt 4 passing over rollers 5 of which only one is visible. The branch 3 is arranged to receive a stream of shredded tobacco leaving a carding unit (not shown) of known type, and to feed it by way of a passage 6 defined between one of the rollers 5 and an upper counter-rotating roller 7, to a chamber 8.

This latter communicates lowerly with a conduit 9 connected to the outlet of a compressed air source 10, and upperly with a rising duct indicated overall by 11 and formed within an upright column 12. This latter is bounded upperly by an inclined surface 13 slidably supporting two belts 14 and 15 of a suction conveyor 16 which are mobile in a direction substantially perpendicular to the plane of FIG. 1.

The belts 14 and 15 are formed from a material which is permeable to the air drawn in by a suction unit 17 comprising two chambers 18 and 19 communicating with the upper surface of the belts 14 and 15 respectively, and separated from each other by a wall 20.

The duct 11 comprises a lower portion constituted by a rising conduit 21, the upper end of which forks to form two rising channels indicated by 22 and 23 respectively, these being disposed substantially as a V and lying side-by-side in a direction transverse to the direction of movement of the belts 14 and 15.

In proximity to their upper end, each channel 22, 23 comprises a zone 24 of increased cross-section, which communicates upperly with a respective slot 25, the upper end of which is disposed in contact with the lower surface of the respective belt 14, 15.

The slots 25 constitute the upper end of the respective channels 22 and 23, and are disposed side-by-side in said direction transverse to the direction of movement of the belts 14 and 15.

In cross-section, the channels 22 and 23 are of substantially rectangular shape of preferably constant dimensions. Conduit 21 has a substantially rectangular cross-section of preferably constant dimensions, and its dimension in said direction parallel to said direction of movement, at least at its lower end, is substantially equal to that of the passage 6.

At its upper end, the conduit 21 is defined laterally by a portion of the outer periphery of two perforated rollers 26 and 27 mounted inside the column 12 to rotate in opposite directions about respective tubular shafts 28 and 29 substantially parallel to said direction of movement and disposed on opposite sides of the conduit 21.

The inner surface of the rollers 26 and 27 is partly shielded by fixed annular segments 30, each defining an aperture 31 through which the conduit 21 communicates with the respective tubular shaft 28, 29.

This latter is connected by a respective conduit 32, 33 controlled by a respective regulator valve 34, 35 to a conduit 36 communicating with an inlet of the source 10.

Inside the column 12, the two channels 22 and 23 are separated from each other by a wall 37 comprising an upper portion 38 of substantially rectangular cross-section, and a lower wedge-shaped portion 38, the lower vertex edge of which is disposed in a position corresponding with the upper end of the conduit 21.

Inside the upper part 38, there is provided a chamber 40 communicating at one end with the channels 22 and 23 by way of a plurality of bores 41, and at the other end with the conduit 36 by way of a conduit 42.

The lower part 39 of the wall 37 can be fixed, or can be provided with a device for regulating the tobacco flow along the channels 22 and 23.

In the preferred embodiments illustrated in FIGS. 1 and 4, said regulating device is constituted by a curved plate 43 shaped as an aileron, which is pivoted upperly on a shaft 44 parallel to the shafts 28 and 29.

The angular position of the curved plate 43 about its shaft 44 can be adjusted by means of an actuator device 45, the outlet rod 46 of which is connected to an intermediate point of the curved plate 43, in order to rotate it about its shaft 44 and fix it in a position which can be chosen at will.

Preferably, but not necessarily, the lower part 39 of the wall 37 is provided at its lower vertex with so-called "de-straddling" means, i.e. means arranged to prevent tobacco particles accumulating on said edge so that they straddle it.

In the embodiment shown in FIG. 1, said de-straddling means comprise a roller 47 mounted rotatably on the wall 37 so that it rotates about an axis parallel to the axes of the rollers 28 and 29.

The roller 47 is disposed at said lower edge, and is connected by a transmission 48 to a drive unit 49 arranged to cause the roller 47 to reciprocate about its axis.

In the further embodiment shown in FIG. 4, said de-straddling means comprise a slot 50 extending along said lower edge of the part 39, and constituting an outlet nozzle for a compressed air circuit.

This latter comprises a chamber 51 provided in the part 39, and communicating at one end with the slot 50 and at the other end with a conduit 52 connected to an outlet of the source 10.

In the embodiment shown in FIG. 5, said de-straddling means comprise two perforated rollers 53 and 54, one on the right and the other on the left, which are tangential to each other and are supported at the lower end of the curved plate 43 by respective tubular shafts 55 and 56 parallel to the shafts 28 and 29. Said tubular shafts 55 and 56, driven with clockwise and anticlockwise motion respectively, communicate with the internal cavities of the rollers 53 and 54 and are connected to said conduit 36 by respective conduits 57 and 58.

In the modification shown in FIG. 2, the belts 14 and 15 are rigid with each other in order to form a suction conveyor 16 comprising a single belt 59, which upperly closes both the slots 25.

In the modification shown in FIG. 3, the belt 59 closes the lower end of two slots 60 aligned with the slots 25, and communicating with a single suction chamber 61 formed by the chambers 18 and 19, by removing the wall 20.

In a modification, not shown, the belt 59 of FIG. 3 can be replaced by the two belts 14 and 15 of FIG. 1.

When in operation, the stream of tobacco particles leaving the passage 6 is deviated upwards by the combined action of the roller 7 and, in particular, the compressed air fed from the source 10 into the chamber 8.

Said compressed air rises upwards along the duct 11, to entrain the tobacco particles upwards so that they engage with the conduit 21 and then with the two channels 22 and 23, to finally deposit on the lower surface of the suction conveyor 16 to form two continuous strips of shredded tobacco on this latter.

During its rise along the conduit 21, the air fed from the source 10 forms a plurality of vortices due mainly to the encounter between the air and the tobacco particles leaving the passage 6, and to the different directions of the air stream and tobacco stream. These vortices contribute to the formation of a substantially homogeneous tobacco flow in the conduit 21.

In other words, the re-mixing which takes place in the conduit 21 and which, in contrast to that which happens in previously known double rod manufacturing machines, concerns the entire flow of tobacco leaving the passage 6, makes the distribution of tobacco particles of different physical characteristics substantially homogeneous in the stream leaving the conduit 21.

Consequently, when this stream is divided by the lower edge of the part 39 of the wall 37 into two streams which rise upwards along the channels 22 and 23, these latter streams have substantially identical physical characteristics, and may differ only in their flow rate.

If the curved plate 43 is present, then this latter quantity can be regulated by varying the inlet sections of channels 22 and 23 by rotating the curved plate 43 about its shaft 44.

The tobacco flow rates along the channels 22 and 23 can also be varied, either in combination with or as an alternative to the use of the curved plate 43, by means of perforated drums 26 and 27, which on being rotated facilitate division of the stream rising along the channel 21 into two streams and, by adjusting their suction using the valves 34 and 35, facilitate the entry of the tobacco into one or other of the channels 22 and 23.

As already stated, the curved plate 43 can be fixed, and the rollers 26 and 27 can be dispensed with, as can the bores 41 and chamber 40.

The rollers 53 and 54 can be without perforations, and therefore not communicate with the conduit 36.

Moreover, whereas the lower ends of the channels 22 and 23 must be disposed side-by-side, the upper ends thereof can be displaced relative to each other in the direction of movement of the suction conveyor 16 such that the channels 22 and 23, taken as a whole, are only partly side-by-side.

Figure 6:
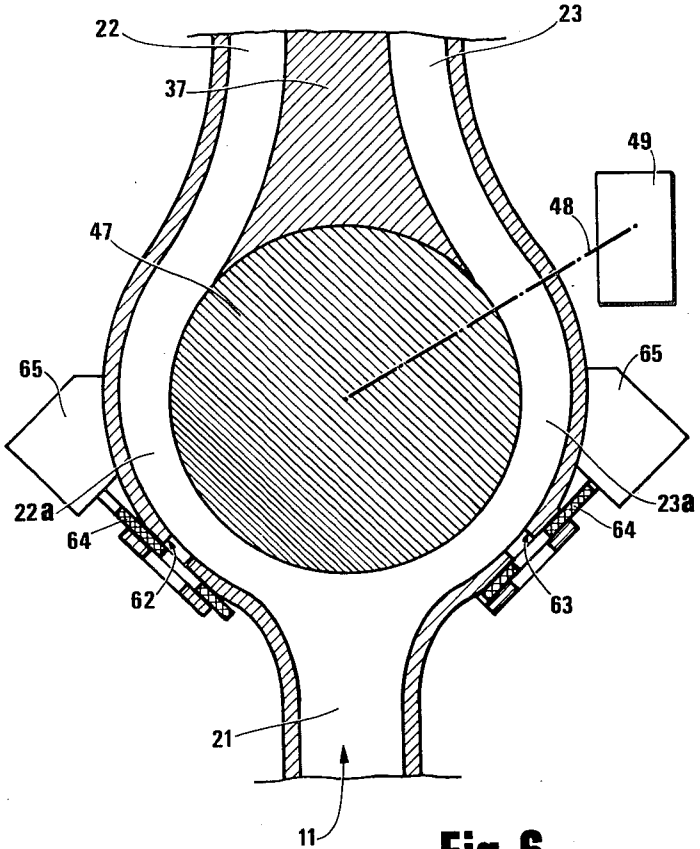

In the modification shown in FIG. 6, the lower portion of the wall 37 is constituted by a cylindrical body of axis substantially parallel to the belts 14 and 15, and having a diameter greater than the average thickness of the wall 37. In the particular embodiment shown, the two channels 22 and 23 have lower portions **22*a* and 23*a*** with a curved axis surrounding said cylindrical body.

According to one modification, not shown, this latter can be constituted by a fixed cylindrical bulb of axis substantially parallel to the axis of the belts 14 and 15. In contrast, in the embodiment shown in the figure, said cylindrical body is constituted by the roller 47, which is connected by the transmission 48 to the drive unit 49. The tobacco flow along the channels 22 and 23 is controlled by a regulating device comprising two slots 62 and 63 formed through the upright column 12 on opposite sides of the rising conduit 21, and in a position corresponding with the upper end thereof. The slots 62 and 63 have axes which intersect substantially on the axis of the roller 47, the former slot being in direct communication with the lower end of the channel 23.

One end of each of the slots 62 and 63 communicates with the outside, and is controlled by a respective valve element 64 arranged to reduce the size of the relative slot 62, 63, and, in the limit, close their communication with the outside, under the thrust of a respective actuator element 65 normally controlled by measuring means, not shown, arranged to control the tobacco quantities disposed on the belts 14 and 15. When in operation, if said measuring means detect an inequality between the tobacco quantities reaching the belts 14 and 15, they progressively open that of the said valve elements 64 which is on the same side of the wall 37 as the belt 14 or 15 receiving more tobacco.

Following the opening of the relative valve element 64, air is drawn into the conduit 21 through the slot 62 or 63, which behaves as an aerodynamic source, the effect of which on the air stream rising inside the column 12 being analogous, in known manner, to that which is obtained by introducing into the conduit 21 a cylindrical body with its axis coinciding with the axis of the slot 62 or 63 through which the air passes, and its diameter proportional to the flow rate.

From the aforegoing, it is clearly apparent that when air enters through the slot 62, there is a corresponding reduction in the rate of flow of air-tobacco mixture able to penetrate into the channel 22, and when air enters through the slot 63 there is a corresponding reduction in the flow rate of air-tobacco mixture able to penetrate into the channel 23. In this manner, by simply operating the actuator elements 65, it is possible to keep the quantities of tobacco reaching the belts 14 and 15 rigorously equal to each other at all times during the entire operating cycle of the manufacturing machine.

Within the principle of the invention, there are numerous modifications which can be made to the regulating device described by way of non-limiting example, without leaving the scope of the present invention.

In a modification, not shown, the slots 62 and 63 are each constituted by a set of openings or bores. In this case, the valve elements 64 can be each replaced by a plurality of shutter elements arranged to each selectively open or close a relative said bore or opening.

In the modification shown in FIG. 7, the wall 37 comprises at its lower end a groove 66, the surface of which is a cylindrical surface extending through an arc less than 180°, and slidably coupled to a cylindrical roller 67 of equal radius, the axis of which extends in a direction substantially parallel to the axis of the belts 14 and 15.

The cylindrical roller 67 constitutes part of a device for regulating the tobacco flow along the channels 22 and 23. For this purpose, the roller 67 is mounted rotatable about its axis relative to the wall 37, and is rotated by a transmission 68 from a drive unit 69 normally controlled by measuring means, not shown, arranged to control the tobacco quantities deposited on the belts 14 and 15. The roller 67 laterally comprises a flat face 70, which is mobile with the roller 67 between a normal rest position in which the face 70 is disposed facing the upper end of the conduit 21 and perpendicular to the axis thereof, and one or other of two end operating positions in which the face 70 is disposed in a position parallel to the axis of the conduit 21 and faces one or other of the channels 22 and 23.

When in operation, movement of the face 70 towards one of said two end operating positions leads to a variation in the cross-section of a portion of one of the channels 22 and 23, while the cross-section of the corresponding portion of the other channel remains constant.

By rotating the roller 67 in one or other direction, it is therefore possible to control the tobacco flows along the channels 22 and 23 and to keep the tobacco quantities reaching the belts 14 and 15 rigorously equal to each other at all times during the entire working cycle of the manufacturing machine.

With regard to this, it should be noted that the tobacco flow rates through the channels 22 and 23 are generally regulated by influencing the aerodynamic conditions of one of the two channels. Obviously, a similar result can be obtained not only by means of the roller 67 provided with the face 70, but with an infinite series of devices arranged to influence the flow of the air-tobacco mixture along one or other of the channels 22 and 23.

What we claim is:

1. A manufacturing machine for simultaneously producing two continuous cigarette rods comprising a substantially horizontal suction conveyor mobile in a predetermined direction of movement, and a duct extending upwards and terminating below said suction conveyor to feed the same with a continuous flow of shredded tobacco particles, said duct comprising a lower inlet portion consisting in a single conduit having an elongated cross-section substantially parallel with said direction of movement, and an upper outlet portion comprising two channels extending fork-like from an upper end of said conduit, said two channels having elongated inlet cross-sections arranged parallel with the cross-section of said conduit, and being side-by-side in a direction transverse to said direction of movement.

2. A machine as claimed in claim 1, characterised in that said two channels (22, 23) are disposed with their upper ends side-by-side in said transverse direction.

3. A method as claimed in claim 1, characterised in that said two channels (22, 23) are separated from each other by a wall element (37), a lower portion (39) of which is substantially of wedge configuration, and is disposed with its vertex facing downwards and towards the upper end of said rising conduit (21).

4. A machine as claimed in claim 3, characterised in that de-straddling means (47–50, 53–54) are carried by said wall element (37) to prevent tobacco particles accumulating so that they straddle said vertex edge.

5. A machine as claimed in claim 4, characterised in that said de-straddling means comprise a roller (47) with its axis parallel to said direction of movement and supported by said wall element (37) at said vertex edge; drive means (48, 49) being provided to cause said roller (47) to reciprocate about the relative said axis.

6. A machine as claimed in claim 4, characterised in that said de-straddling means comprise a slot (50) formed in said wall element (37) along said vertex edge; said slot (50) constituting an outlet nozzle for a compressed air feed circuit (51, 52, 10).

7. A machine as claimed in claim 4, characterised in that said de-straddling means comprise two counter-rotating rollers (53, 54) which are tangential to each other, their axes being parallel to said direction of movement and they being supported by said wall element (37) at said vertex edge.

8. A machine as claimed in claim 7, characterised in that the rollers (53, 54) are perforated peripherally, and communicate internally with air suction means (10).

9. A machine as claimed in claim 3, characterised by comprising regulating device for controlling the tobacco flow along said two channels (22, 23).

10. A machine as claimed in claim 9, characterised in that said regulating device comprises two rollers (26, 27), a peripheral portion of which defines the opposing lateral surface of an upper portion of said conduit (21); said two rollers (26, 27) being mounted on shafts (28, 29) substantially parallel to said direction of movement in order to rotate about these in opposite directions, and comprising radial bores for communication with air suction means (10).

11. A machine as claimed in claim 9, characterised in that said regulating device comprises at least two apertures (62, 63) controlled by respective valve elements (64) and arranged to put the lower end of each said channel (22, 23) in direct communication with the outside.

12. A machine as claimed in claim 11, characterised in that said wall element (37) comprises a lower portion of substantially cylindrical shape, said cylindrical lower portion being disposed with its axis in a direction substantially parallel to said direction of movement, and having a diameter greater than the average thickness of said wall (37).

13. A machine as claimed in claim 9, characterised in that said regulating device is disposed at the lower end of said wall element (37).

14. A machine as claimed in claim 13, characterised in that said regulating device comprises a curved plate (43) of substantially triangular cross-section mounted rotatably about a shaft (44) substantially parallel to said direction of movement; actuator means (45) being provided in order to fix said curved plate (43) in an adjustable position about said shaft (44).

15. A machine as claimed in claim 13, characterised in that said regulating device comprises a roller (67) connected to the lower end of said wall element (37) and disposed with its axis substantially parallel to said direction of motion; said roller (67) comprising a lateral face (70), actuator means (68, 69) being provided in order to rotate said roller (67) about its axis and move said face (70) towards one or other of said two channels (22, 23).

16. A machine as claimed in claim 1, characterised in that said wall element (37) comprises, in a position corresponding with an upper portion of said channels (22, 23), a plurality of bores (41) communicating at one end with said channels (22, 23) and at the other end with air suction means (10).

17. A machine as claimed in claim 1, characterised in that said suction conveyor (16) comprises air suction chamber means (17), and air-permeable belt means (14, 15, 59) disposed between the upper end of said channels (22, 23) and said chamber means (17).

18. A machine as claimed in claim 17, characterised in that said belt means comprise two belts (14, 15), each disposed facing the upper end of the respective said channel (22, 23).

19. A machine as claimed in claim 18, characterised in that said chamber means (17) comprise a single suction chamber (61) communicating with both said channels (22, 23).

20. A machine as claimed in claim 18, characterised in that said chamber means (17) comprise two suction chambers (18, 19), each communicating with a respective said channel (22, 23).

21. A machine as claimed in claim 17, characterised in that said belt means comprise a single belt (59) disposed facing the upper end of both said channels (22, 23).

* * * * *